US006349856B1

(12) United States Patent
Chastel

(10) Patent No.: US 6,349,856 B1
(45) Date of Patent: Feb. 26, 2002

(54) DISPENSING DEVICE WITH CONICAL SOCKETING FIXING RING

(75) Inventor: Jerry Chastel, Bourgtheroulde (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/486,571

(22) PCT Filed: Aug. 31, 1998

(86) PCT No.: PCT/FR98/01868

§ 371 Date: Jun. 14, 2000

§ 102(e) Date: Jun. 14, 2000

(87) PCT Pub. No.: WO99/11387

PCT Pub. Date: Mar. 11, 1999

(30) Foreign Application Priority Data

Sep. 2, 1997 (FR) ..... 97 10881

(51) Int. Cl.[7] ..... B67D 5/40
(52) U.S. Cl. ..... 222/321.7; 222/308.1
(58) Field of Search ..... 222/321.7, 321.9, 222/380, 383.1, 402.1

(56) References Cited

U.S. PATENT DOCUMENTS 3,937,366 A 2/1976 Steiman
5,292,033 A * 3/1994 Gueret ..... 222/321.7
5,649,649 A * 7/1997 Marelli ..... 222/321.9
5,709,324 A * 1/1998 Peronnet et al. ..... 222/321.9
6,010,039 A * 1/2000 Bougamont ..... 222/321.9
6,073,805 A * 6/2000 Gueret ..... 222/321.7

OTHER PUBLICATIONS

Rapport de Recherche International for PCT/FR98/01868 (International Search Report).

* cited by examiner

*Primary Examiner*—Joseph A. Kaufman
(74) *Attorney, Agent, or Firm*—Rockey, Milnamow & Katz, Ltd.

(57) ABSTRACT

The invention concerns a device for dispensing a fluid product designed to be mounted in a reservoir neck, the device comprising: a dispensing member, such as a pump, comprising a body and a mobile actuating rod in the body; and a fixing ring comprising a housing for receiving the body and a socketing skirt to be adapted in the reservoir neck. The invention is characterized in that the skirt outer wall is provided with at least a peripheral bead adapted to be urged or pressed against the reservoir inner wall.

12 Claims, 3 Drawing Sheets

DISPENSING DEVICE WITH CONICAL SOCKETING FIXING RING

TECHNICAL FIELD

The present invention relates to a fluid dispenser device for mounting in the neck of a tank, which neck may, depending on circumstances, have an inside wall in the form of an upwardly-flaring cone. More particularly, the present invention relates to a fixing ring suitable for receiving the body of a dispenser member such as a pump, the ring also having an engagement skirt of shape corresponding to the shape of the wall of the neck so as to fit in the neck of the tank.

BACKGROUND OF THE INVENTION

By way of example, document DE-85608 discloses a dispenser device in which a pump is mounted in a plug having a conical outer wall. The plug with a conical outer wall is coated in a covering of rubber. The neck of the tank to which the plug is to be fitted also has a neck whose inside wall is conical to match the plug. The rubber covering of the plug serves to improve fixing and sealing of the plug in the conical neck. However, because sealing contact takes place over the entire frustoconical surface area of the plug, it is difficult to push the plug into the conical neck. Given that the pressure force exerted on the plug is distributed uniformly over the entire frustoconical contact area, it follows that the plug is nowhere in high-pressure contact with the conical neck of the tank. A major drawback results from this fact, whereby the plug is not very well retained in the neck and can come out. Consequently, the use of a rubber covering does not make it possible to obtain good fixing and proper sealing.

Another document, U.S. Pat. No. 3,937,366 discloses a dispenser having a tank whose neck is accurately cylindrical, and in which a pump-receiving fixing ring is engaged. For this purpose, the fixing ring has an engagement skirt whose outer wall is cylindrical. To improve fixing of the ring in the neck of the tank, the engagement skirt has a peripheral annular rib provided thereon and the inner wall of the neck of the tank has a peripheral annular groove. Once the fixing ring has been mounted in the neck of the tank, the peripheral annular bead becomes engaged in the peripheral annular groove. The shapes of the peripheral bead and of the peripheral groove are exactly complementary so no pressure is exerted on the bead when it is inside the groove. Consequently, that bead-and-groove arrangement does not contribute to improving sealing between the fixing ring and the neck of the tank, and serves merely-to provide good fixing.

SUMMARY OF THE INVENTION

An object of the present invention is to remedy the above-mentioned drawbacks of the prior art by defining a dispenser device whose fixing ring provides an engagement that is entirely leakproof and a fixing that is reliable.

For this purpose, the present invention provides a fluid dispenser device for mounting in a tank neck, the device comprising: a dispenser member, such as a pump, comprising a body and an actuator rod movable in said body; and a fixing ring comprising a reception housing for receiving said body and an engagement skirt whose outer wall is of a shape corresponding to the shape of the wall of the neck so as to fit in said neck of the tank; the outer wall of the skirt being provided with at least one peripheral sealing bead adapted to be compressed against the inner wall of the tank neck. Thus, engagement is entirely leakproof and secure given that all of the force exerted to engage the ring gives rise to annular contact that is very strong because the bead is compressed against the inner wall of the neck. Unlike the above-mentioned German document, sealing contact takes place on a circle only and not over a frustoconical surface, thereby increasing the contact force against the inner wall of the neck. In addition, unlike the above-mentioned American document, entirely leakproof contact is established because the bead cannot snap into a groove of corresponding shape but on the contrary is completely compressed against the inner wall of the neck.

According to an advantageous characteristic, the conical outer wall of the skirt is provided with two peripheral sealing beads. The fact of providing two sealing beads on the ring makes it possible further to improve the stability of the ring inside the neck. Together the two sealing beads define two spaced-apart circles such that the ring can no longer tilt inside the neck. In addition, sealing is also improved because the sealing barrier is duplicated.

According to another characteristic, the skirt extends around the body with radial separation that forms an annular gap. The fact that the inner wall of the ring is not in contact with the body of the dispenser member enables the skirt to deform inwards during compression of the bead(s) inside the conical neck of the tank.

According to another aspect of the invention, the fixing ring forms a guide collar for an actuator head mounted on the actuator rod.

In an embodiment, the inner wall of the neck and the engagement skirt of the ring are in the shape of upwardly-flared cones.

The invention is described in greater detail below with reference to the accompanying drawings showing an embodiment of the invention by way of non-limiting example.

DETAILED DESCRIPTION OF THE PREFERRED EMBODIMENT

Figure 1:
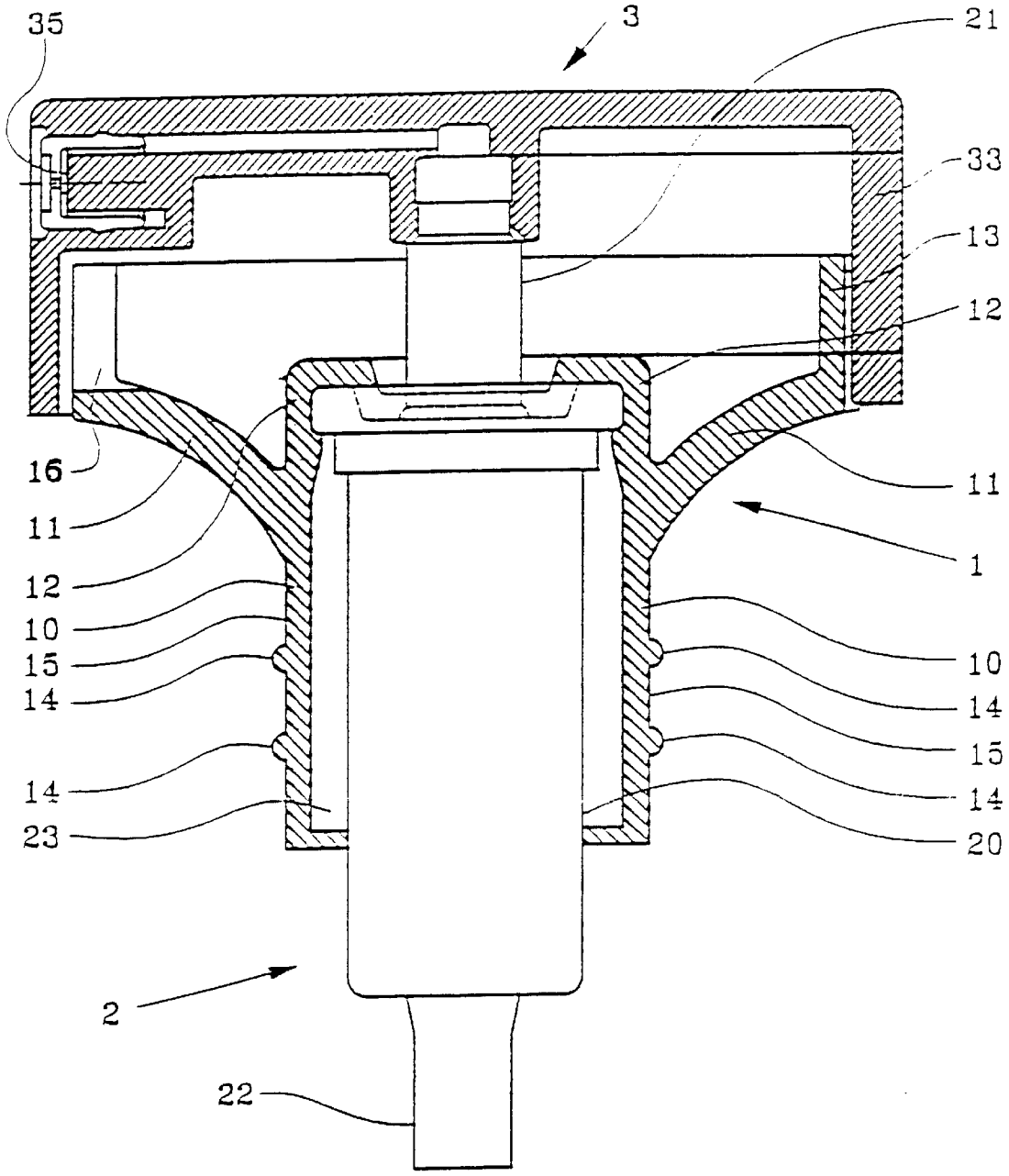
FIG. 1 is a vertical section view through a dispenser member of the invention.

As can be seen in the figures, the fluid dispenser device of the invention comprises three essential component elements, namely: a tank 4, a dispenser member 2, and a fixing ring 1 for mounting the dispenser member 2 in the neck of the tank 4.

The tank 4 defines an internal volume in which the fluid is stored, and a neck 40 at the top of the tank provides access to the inside of the tank. In the context of the invention, the neck 40 of the tank 4 has an inside wall 41 that is cylindrical in shape, as can be seen in the figures. In a variant, the inner wall 41 could equally well be conical in shape, flaring upwards. Advantageously, if the tank is made of glass, in order to obtain satisfactory surface quality, the conical inner wall 41 could be lapped.

The dispenser member 2 can be a pump, for example, but it is also possible to envisage using a valve. In the example shown, it comprises a pump 2 having a pump body 20 within which an actuator rod 21 is movable. The internal structure of the pump is not critical for the invention, and consequently it is not described. At the top end of the actuator rod 21, there is mounted an actuator head 3, advantageously provided with a spray nozzle 35. By pressing on the actuator head 3, the actuator rod 21 is pushed into the pump body 20, thereby delivering fluid from the pump body through the actuator rod and then through the nozzle 35. This kind of pump operation is entirely conventional.

To fix the dispenser member 2 on the neck 40 of the tank 4, the invention provides a fixing ring 1 which comprises firstly a reception housing 12 for receiving the pump body 20, advantageously by snap-fastening, and secondly an engagement skirt 10 which extends downwards from the reception housing. The engagement skirt 10 has an outer wall of a shape that corresponds to the shape of the wall of the neck, i.e. cylindrical in the drawings, but it could equally well be conical in shape when the wall of the neck is conical, being of a size and of a cone angle that enable it to fit in the conical neck of the tank. The fixing ring can thus be engaged by force on the tank by engaging the cylindrical or conical engagement skirt 10 in the cylindrical or conical neck 40 of the tank. According to the invention, the cylindrical or conical outer wall 15 of the engagement skirt 10 is provided with at least one peripheral sealing bead 14 adapted to be compressed against the inner wall 41 of the neck of the tank 40. In the example shown in the figures, the cylindrical outer wall 15 is provided with two peripheral sealing beads 14. The two peripheral sealing beads 14 thus project from the outer wall 15 of the skirt 10 in the form of small swellings. In addition, the two peripheral sealing beads 14 are spaced apart from each other by a certain distance, thus providing advantageous effects concerning the stability of the ring, as explained below. The fixing ring 1 also forms an annular flange 11 which extends outwards from the top end of the engagement skirt 10. This annular flange 11 is terminated by a cylindrical guide collar for guiding the actuator head 3 that is mounted on the actuator rod 1. As can be seen in the figures, the actuator head 3 has a skirt 33 which extends downwards around the cylindrical collar 13. Thus, when the actuator head 3 is actuated it is guided by its skirt engaging on the collar 13. To enable the actuator head 3 to be pressed down, the collar 13 is provided with a notch 16 for receiving the nozzle 35.

Figure 2:
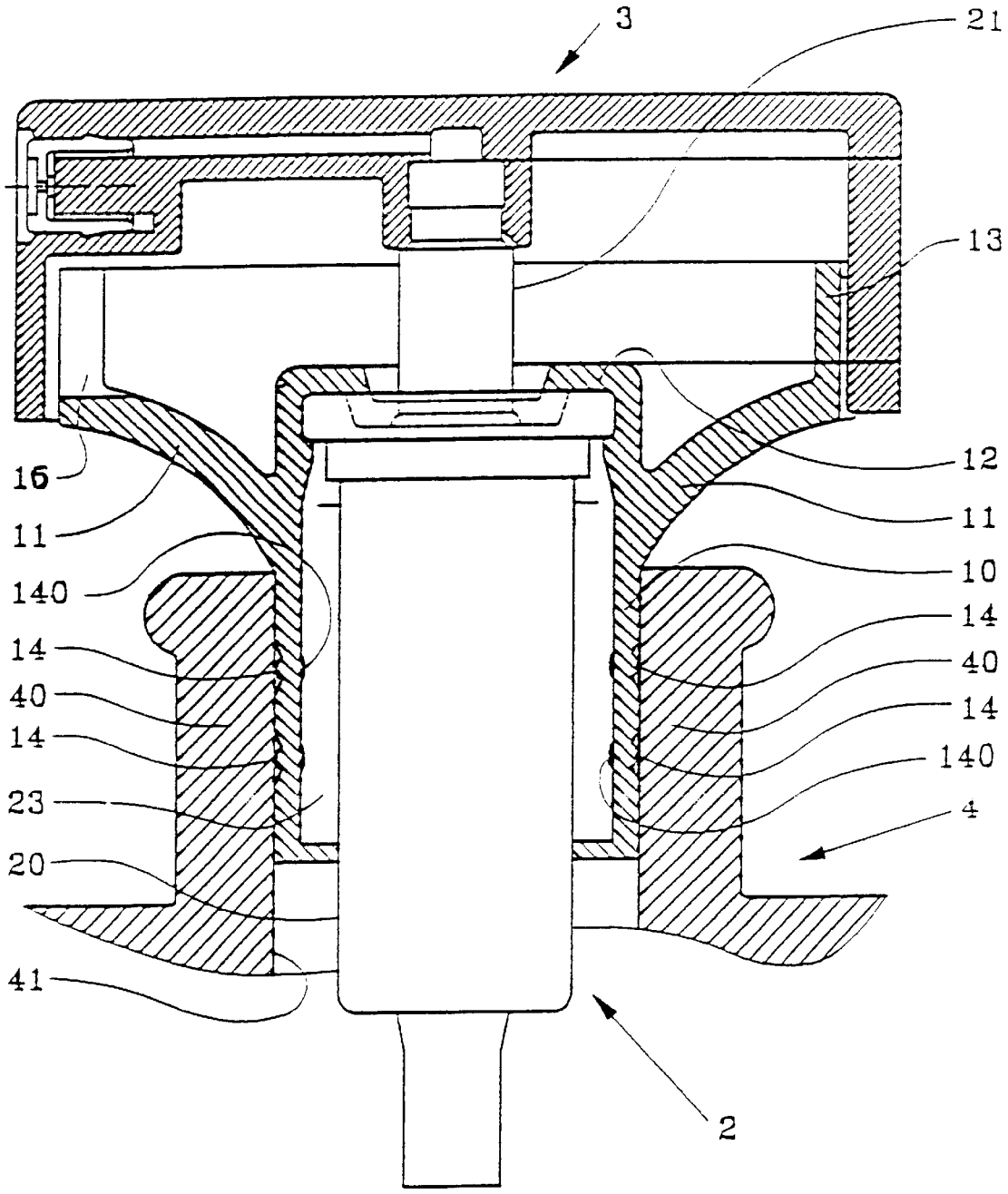
FIG. 2 is a cross-section view of the FIG. 1 dispenser member mounted on the neck of a tank in accordance with the invention.
Figure 2A:
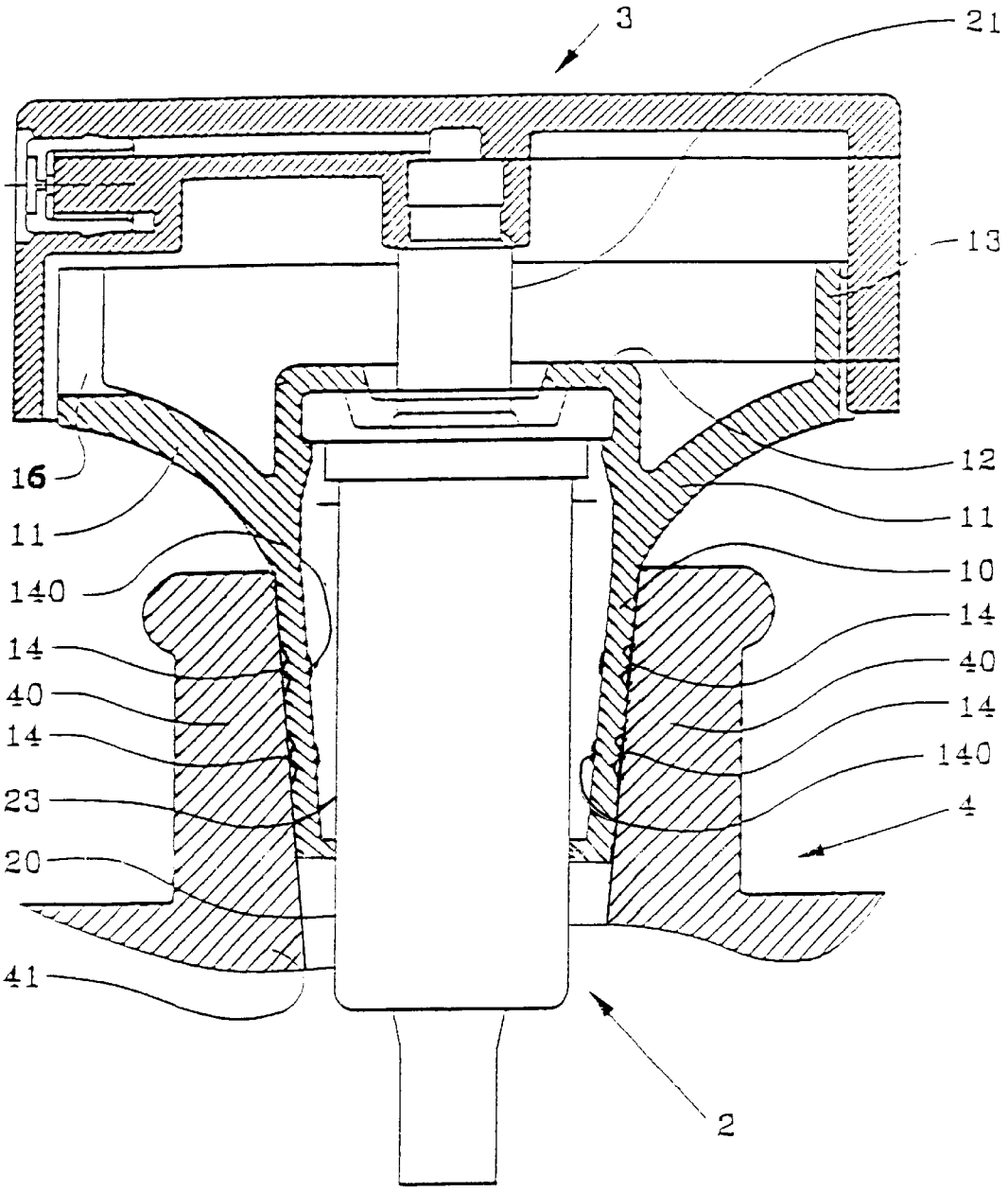
FIG. 2*a* is cross-sectional view of an alternate dispenser member mounted on the neck of an alternate tank in accordance with another aspect of the invention.

Reference is now made more particularly to FIG. 2 which shows the dispenser member mounted in a cylindrical neck 40 by means of a fixing ring 1 of the invention. As can be seen in this figure, the outer wall 15 of the skirt 10 fits exactly in contact with the inner wall 41 of the neck 40. In fact, a very small gap (not visible to the naked eye) may exist between these two walls, however that has no ill effect either on fixing or on sealing the device. Because of the presence of two peripheral sealing beads 14, both fixing and sealing of the fixing ring in the neck 40 of the tank are good. In the engaged position, as shown in FIG. 2, the two peripheral sealing beads 14 are highly compressed against the inner wall 41 of the neck 40. The compression of these beads 14 exerts strong annular pressure on the inner wall 41 of the neck 40. The sealing beads 14 are almost completely flattened so that they hardly project any more from the outer wall 15 of the skirt 10. This provides sealing that is good and reliable. In addition, since there are two sealing beads 14, two sealing barriers are thus provided. In terms of fixing, the presence of two sealing beads provides a corresponding improvement in fixing in that between them the two sealing beads define a stable cylindrical assembly. In addition, as mentioned above, the gap between the two beads further contributes to stability by defining a greater frustoconical or cylindrical section. Although it is possible in the context of the invention to envisage providing only one sealing bead, it is preferable to provide two sealing beads for the above-mentioned reasons of stability and sealing. It should also be observed that the engagement skirt 10 is not in contact via its inner wall with the body 20 of the pump 2. This allows the skirt 10 to deform inwards as referenced 140 in FIG. 2 while the sealing beads 14 are being compressed inwards. This avoids deforming the pump body 20 since that could impede its operation.

The tank 4 is preferably made of glass, although other materials are not excluded, and the fixing ring 1 is preferably made of a plastics material although other materials are likewise not excluded. With a glass tank and a plastics ring, the sealing bead(s) is/are well compressed against the inner wall 41 of the glass neck 40. Improved sealing is obtained in accordance with the invention by compressing the sealing bead(s), and improved fixing is obtained by having two beads.

What is claimed is:

1. A fluid dispenser device for mounting in a tank neck, the tank neck having an inner wall, the device comprising:

a dispenser member comprising a body and an actuator rod movable in said body; and a fixing ring comprising a reception housing for receiving said body and an engagement skirt to fit in said neck of the tank, the skirt having an outer wall, the outer wall of the skirt and the inner wall of the neck being of identical general shape;

the device being characterized in that the outer wall of the skirt is provided with a least one peripheral sealing bead adapted to be compressed, when the skirt is in the mounted state in the neck, against the inner wall of the neck of the tank, said sealing bead extending substantially continuously around the periphery of said outer wall, said outer wall extending in two opposite directions from said sealing bead so as to define (1) a peripherally continuous lower surface that (a) extends downwardly from and below said bead, and (b) has a diameter less than the diameter of said bead, and (2) a peripherally continuous upper surface that extends upwardly from and above said bead, said bead projecting radially from both said upper and lower surfaces.

2. A dispenser device according to claim 1, in which the outer wall of the skirt is provided with two peripheral sealing beads.

3. A dispenser device according to claim 1, in which the skirt extends around the body with radial separation that forms an annular gap.

4. A dispenser device according to claim 1, in which the fixing ring forms a guide collar for an actuator head mounted on the actuator rod.

5. A dispenser device according to claim 1, in which the inner wall of the neck and the engagement skirt of the ring are in the shape of upwardly-flared cones.

6. A fluid dispenser device for mounting in a container neck, the container neck having an inner wall, the device comprising:

a dispenser member comprising a body and an actuator rod movable in said body; and a fixing ring comprising a reception housing for receiving said body, and an engagement skirt shaped to fit in said container neck;

said skirt having an outer wall, with a substantially flat annular surface and at least one sealing bead extending from said substantially flat annular surface and adapted to be compressed when the skirt is inserted into said neck, against the inner wall of the neck, said sealing bead extending substantially continuously around the periphery of said outer wall, said outer wall extending in two opposite directions from said sealing bead so as to define (1) a peripherally continuous lower surface that (a) extends downwardly from and below said bead, and (b) has a diameter less than the diameter of said bead, and (2) a peripherally continuous upper surface that extends upwardly from and above said bead, said bead projecting radially from both said upper and lower surfaces.

7. A dispenser device according to claim 6, in which the outer wall of the skirt is provided with two spaced-apart peripheral sealing beads.

8. A dispenser device according to claim 6, in which the skirt extends around the body with radial separation that forms an annular gap.

9. A dispenser device according to claim 6, in which the fixing ring forms a guide collar for an actuator head mounted on the actuator rod.

10. A dispenser device according to claim 6, in which the inner wall of the neck and the engagement skirt of the ring are in the shape of upwardly-flared cones.

11. A dispenser device according to claim 6, wherein said outer wall of said skirt and said at least one sealing bead are formed in unitary fashion.

12. A dispenser device according to claim 6, wherein said outer wall of said skirt is provided with two spaced-apart peripheral sealing beads formed in unitary fashion with said outer wall.

* * * * *